United States Patent [19]

Noda et al.

[11] Patent Number: 4,491,198

[45] Date of Patent: Jan. 1, 1985

[54] APPARATUS FOR SIGNALING ELEVATOR MALFUNCTIONS

[75] Inventors: Masahiro Noda; Tatsuo Misu, both of Aichi, Japan

[73] Assignee: Mitsubishi Denki Kabushiki Kaisha, Japan

[21] Appl. No.: 492,328

[22] Filed: May 6, 1983

[30] Foreign Application Priority Data

May 7, 1982 [JP] Japan ..... 57-76396

[51] Int. Cl.[3] ..... B66B 5/02

[52] U.S. Cl. ..... 187/29 R; 179/90 B

[58] Field of Search ..... 187/29; 179/5 R, 5 P, 179/90 B; 340/19, 20

[56] References Cited

U.S. PATENT DOCUMENTS

| | | | |
|---|---|---|---|
| 3,626,102 | 12/1971 | Cameron | 179/5 P |
| 3,703,607 | 11/1972 | Cohen | 179/5 P |
| 3,973,648 | 8/1976 | Hummert et al. | 187/29 |
| 4,397,377 | 8/1983 | Husson et al. | 187/29 |
| 4,418,795 | 12/1983 | Trosky et al. | 187/29 |

FOREIGN PATENT DOCUMENTS

| | | | |
|---|---|---|---|
| 53-111953 | 9/1978 | Japan | 340/19 R |

*Primary Examiner*—S. J. Witkowski
*Assistant Examiner*—W. E. Duncanson, Jr.
*Attorney, Agent, or Firm*—Sughrue, Mion, Zinn, Macpeak, and Seas

[57] ABSTRACT

When a start failure detecting circuit detects a start failure of an elevator cage, a signal transmitting and receiving device automatically dials a telephone number of a maintenance and service company to connect a telephone line thereto and at the same time transmits a recorded signal from a signal recording device to the maintenance and service company over the telephone line. The maintenance and service company decides how serious the start failure is on the basis of the transmitted recorded signal. When the start failure is determined as being less serious, the maintenance and service company transmits a restoration signal to the signal transmitting and receiving device. In response to the restoration signal, a reset circuit generates a reset signal to bring the control board back to the same condition as when the power supply is initially switched on, to thereby restore the disabled elevator.

11 Claims, 8 Drawing Figures

APPARATUS FOR SIGNALING ELEVATOR MALFUNCTIONS

BACKGROUND OF THE INVENTION

The present invention relates to an apparatus for signaling or sending signals indicative of elevator malfunctions.

There have been known prior apparatus for signaling elevator malfunctions. Certain elevator problems, when removed, require a self-hold relay circuit, for example, to be released, and at the same time the power supply should be switched on or a reset circuit in a control board energized. Under such conditions, the cause of failure is unknown,and the elevator remains out of service until service personnel from the maintenance company repair the elevator. Accordingly, the prior apparatus has suffered from a problem such that it takes a relatively long period of time before the elevator can be restored to service.

SUMMARY OF THE INVENTION

Accordingly, it is an object of the present invention to provide an apparatus for signaling elevator malfunctions to restore a disabled elevator from less serious malfunctions via a restoration command transmitted over a telephone line between the apparatus and a maintenance company.

According to the present invention, an apparatus for signaling malfunctions of an elevator comprises a control board for controlling the elevator, a start failure detecting circuit for detecting an elevator start failure based on a control signal from the control board, a signal recording device for recording an elevator operation signal from the control board and for holding recorded conditions prior and subsequent to the elevator start failure based on an output from the start failure detecting circuit, a signal transmitting and receiving device responsive to the output from the start failure detecting circuit for automatically dialing a telephone number of a maintenance and service center to transmit data recorded by the signal recording device to the maintenance and service center and for receiving a restoration command from the maintenance and service center, and a reset circuit responsive to the restoration signal received by the signal transmitting and receiving device for restoring the control board back into the same condition as when the power supply therefor is initially switched on.

With the foregoing arrangement, elevator operation signals in the control board are recorded and information recorded prior and subsequent to an elevator start failure is delivered to the maintenance and service center. The maintenance and service center is capable of easily analyzing the cause of the start failure. When the start failure is less serious, the maintenance and service center transmits a restoration command over a telephone line to readily restore the elevator to service. One advantage is that the maintenance and service center may reduce the maintenance cost through less frequent dispatch of service personnel.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
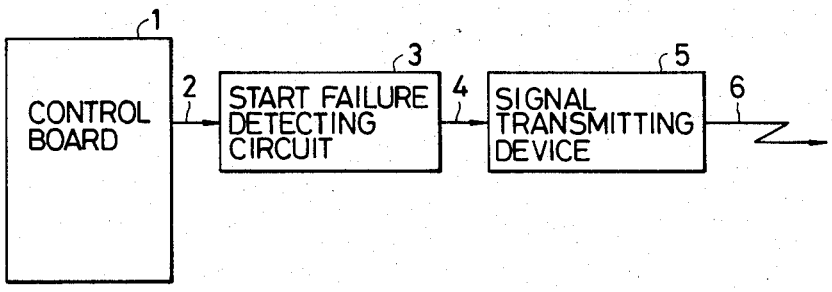
FIG. 1 PRIOR ART
FIG. 1 is a block diagram of a conventional apparatus for signaling elevator malfunctions.

FIG. 1 is illustative of a conventional apparatus for signaling elevator malfunctions, as disclosed by Japanese patent Laid-Open publication No. 51-87237, published on July 30, 1973. The apparatus comprises a control board 1 for controlling an elevator. The control board 1 is capable of transmitting a control signal used for detecting a condition in which the elevator is not available for service, a condition in which passengers are unable to escape from an elevator that has accidentally stopped between floors, and other conditions. The control signal is applied to a start failure detecting circuit 3, which then issues a start failure signal 4 to a signaling device 5. The signaling device 5 is responsive to the start failure signal 4 for automatically dialing a predetermined telephone number of a maintenance company over a telephone line 6 connected to the maintenance company.

The operation of the prior apparatus is as follows: A control signal from a relay coil, contact or the like in the control board 1, that is, a control signal 2 necessary for detecting an elevator start failure, is entered into the start failure detecting circuit 3. The start failure detecting circuit 3 then determines the condition of the control signal 2 and generates a start failure signal 4. On receiving the start failure signal 4, the signaling device 5 automatically calls the maintenance company to inform the company of the fact that the elevator has been put out of service through the telephone line.

The conventional apparatus is effective only to announce the out-of-service condition of the elevator. Such a capability suffers no problem as far as the elevator is automatically restorable after the cause of the failure, such as a power supply failure, has been removed. However, some problems require a self-hold relay circuit, for example, to be released after the failure has been eliminated, and at the same time the power supply should be switched on or a reset circuit in the control board should be energized. Under such conditions, the cause of the failure is unknown, and the elevator remains out of service until service personnel from the maintenance company repair the elevator. Accordingly, the prior apparatus is disadvantageous in that it takes a relatively long period of time before the elevator is restored to service.

An apparatus for signaling elevator malfunctioning according to an embodiment of the present invention will now be described.

Figure 2:
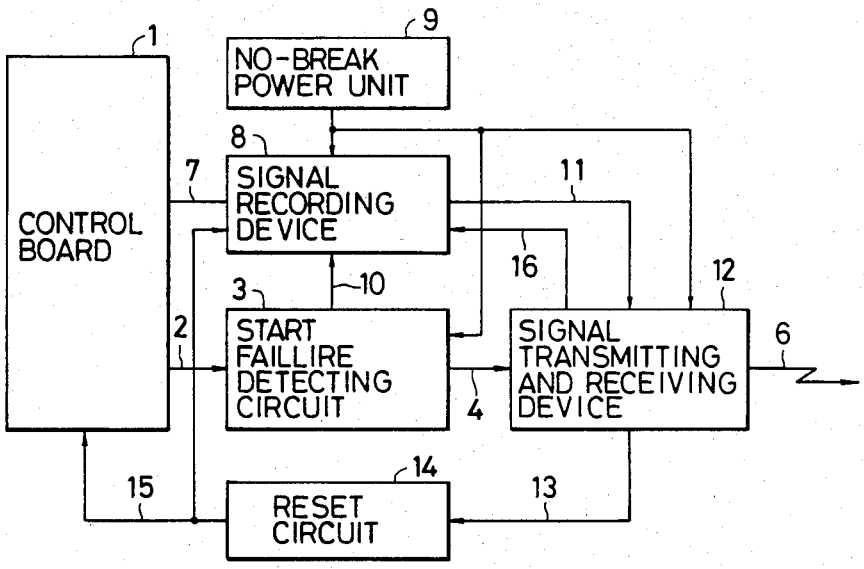
FIG. 2 is a block diagram of an apparatus for signaling elevator malfunctions accordng to the present invention.

As shown in FIG. 2, a control board 1 issues an elevator operation signal 7 which monitors operation of an elevator, to a signal recording device 8 that serves to record movements of the elevator continuously in an endless manner. The signal recording device 8 is stopped in its recording operation by a recording stop signal 10 applied by a start failure detecting circuit 3. A no-break power unit 9 supplies electric power to the start failure detecting circuit 3, the signal recording device 8, and a signal transmitting and receiving device 12 (described later). A recorded signal 11 indicative of elevator operating conditions prior and subsequent to the generation of the start failure is applied from the signal recording device 10 to the signal transmitting and receiving device 12. The signal transmitting and receiving device 12 is responsive to the start failure signal 4 for automatically dialing a predetermined telephone number of a maintenance and service company and sending the recorded signal 11 to the maintenance company. The signal transmitting and receiving device 12 also serves to receive a restoration command sent from the maintenance and service company. The restoration command is then supplied as a signal 13 from the signal transmitting and receiving device 12 to a reset circuit 14, which in turn delivers a reset signal 15 to the control board 1 and the signal recording device 8. A data readout signal 16 from the maintenance and service company is also received by the signal transmitting and receiving device 12 and serves to read the recorded signal 11 out of the signal recording device 8 and send this signal back to the maintenance and service company.

The operation of the apparatus constructed as described in the foregoing will now be described.

The elevator operation signal 7 from the control board 1 is recorded continuously by the signal recording device 8 which operates in an endless recording mode such that as information is fully recorded on the recording medium, older information previously recorded is erased and new information is recorded at erased storage locations. At the time of a power failure, the signal recording device 8 is backed up by the no-break power unit 9 to protect recorded information against unwanted erasure.

When a start failure is detected by the start failure detecting circuit 3, the telephone line 6 is connected to the maintenance and service company through automatic dialing by the signal transmitting and receiving device 12. At the same time, the recorded signal 11 is transmitted from the signal recording device 8 over the line 6 to the maintenance and service company. The maintenance and service company then decides how serious the start failure is on the basis of the content of the recorded signal 11. If the failure is determined as being a less serious one, a restoration command is issued by the maintenance and service company to the signal transmitting and receiving device 12, which then delivers a restoration command 13 to the reset circuit 14. The reset circuit 14 in turn generates a reset signal 15 that brings the control board 1 into the same condition as when the power supply is switched on, to thereby restore the elevator that has been subjected to start failure back to service. The illustrated embodiment is particularly useful in the following instances:

(1) When the elevator cage is stopped between floors (with passengers trapped in the cage);

(2) When an abnormal condition results due to a momentary power failure or difficulties other than the ordinary sequence of switching the power supply on and off; and (3) When no supervisor is readily available (it has been customary practice to call the supervisor to ask him to switch the power supply on and off).

With the illustrated arrangement, it is possible for the maintenance and service company to analyze information provided prior to and subsequent to the start failure. This makes it easy for service personnel to select the suitable tools, maintenance parts, etc. which will be needed before leaving for the disabled elevator.

Figure 3:
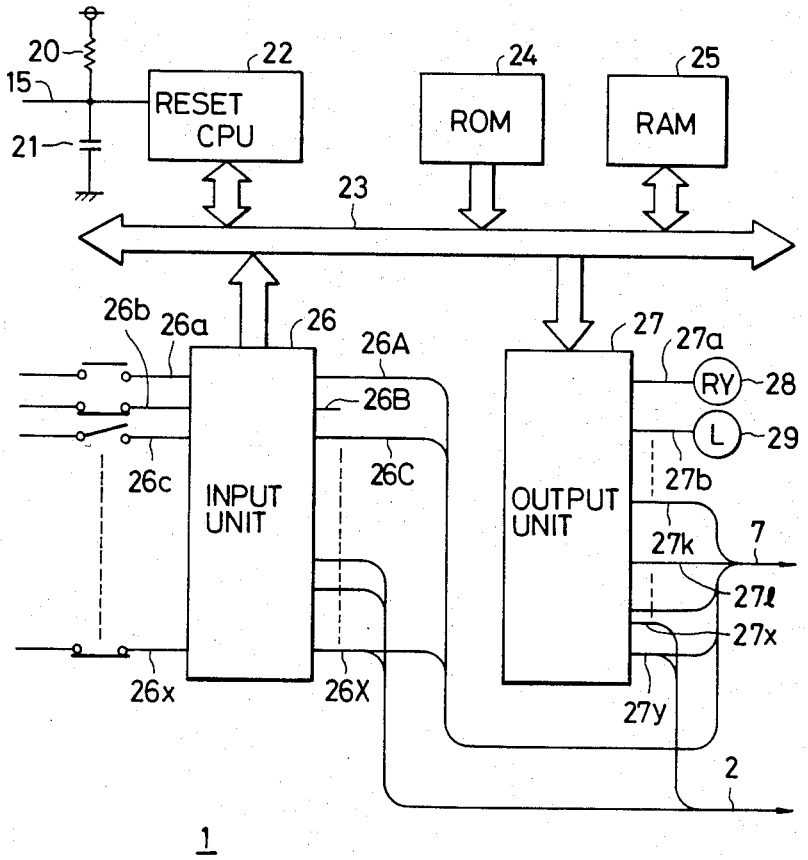
FIG. 3 is a block diagram of a control board of the apparatus shown in FIG. 2.

FIG. 3 shows the control board 1 in more detail. The control board 1 includes a microcomputer (hereinafter referred to as a "CPU") 22 receptive of a reset signal 15 for controlling an elevator, resistor 20 connected between a terminal of a power supply for the microcomputer 22 and a reset terminal of the microcomputer 22, a capacitor 21 coupled between the resistor 20 and the other terminal of the power supply, a bus 23 for transmitting data between the CPU 22 and other devices, a read-only memory (hereinafter referred to as a "ROM") 24 for storing the program for the CPU 22 and other data, a random-access memory (hereinafter referred to as a "RAM") 25 for temporarily storing data during arithmetic operations carried out by the CPU 22, and an input unit 26 for receiving external signals necessary for effecting arithmetic operations in the CPU 22. Designated at **26*a* through 26*x* are relays and switches in the control board and switches in the elevator shaft and the machine room, and 26A through 26X are relay and switch signals derived by converting siganls from the relays and switches 26*a* through 26*x* into different signal levels. An output unit 27 serves to drive an external relay 28, a lamp 29, and other devices based on the results of arithmetic operations in the CPU 22. Designated at 27*a* through 27*y* are signals derived from the results of arithmetic operations in the CPU 22**.

An elevator operation signal 7 is composed of a group of signals selected from the converted signals **27*a* through 26*x* from the input unit 26 and the signals 27*a* through 27*y* from the output unit 27 for monitoring the movements of the elevator. A control signal 2 is composed of a group of signals selected from the converted signals 26A through 26X from the input unit 26 and the signals 27*a* through 27*y* from the output unit 27 for detecting the start failure of the elevator. The operation of the circuit arrangement of FIG. 3 is as follows: When the power supply is switched on, the capacitor 21 starts to be charged through the resistor 20. The reset terminal of the CPU 22 is initially at the logic level "L" and the CPU 22 and the devices connected therewith through the bus 23 are initialized. Then, the voltage across the capacitor 21 is increased until the reset terminal of the CPU 22 reaches the logic level "H". The CPU 22 now starts executing the program stored in the ROM 24 to effect arithmetic operations on the signal from the input unit 26 and the data stored in the ROM 24 and the RAM 25, and stores the results in the RAM 25 or drives the relay 28 and the lamp 29 through the output unit 27 based on these results to thereby control the operation of the elevator. The reset signal 15 is normally of the high logic level. When the reset circuit 14 is operated, the reset signal 15 sequentially changes from the logic level "H" to the logic level "L" and then to the logic level "H". When the reset signal 15 goes low, the capacitor 21 is discharged to allow the CPU 22** to then start operating in the same manner as when the power supply is first switched on.

Figure 4:
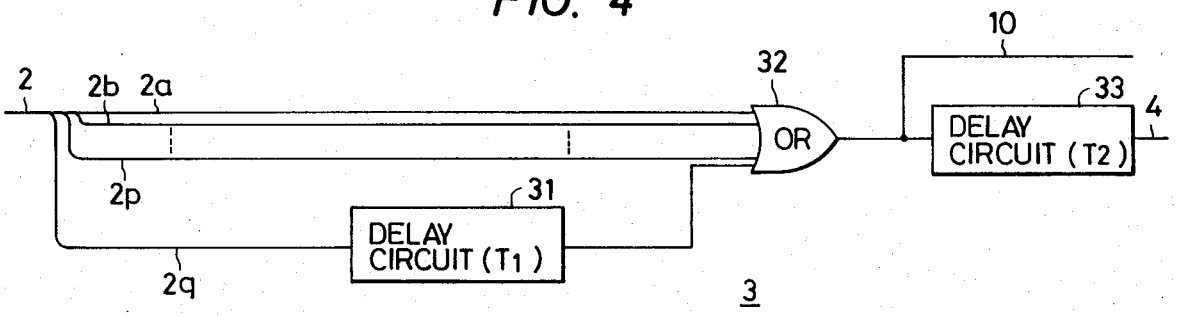
FIG. 4 is a block diagram of a start failure detecting circuit of the apparatus of FIG. 2.

FIG. 4 shows the start failure detecting circuit 3 in detail. The control signals 2 necessary for detecting an elevator start failure include signals *2a* through *2p* issued from an overshooting limit switch disposed at the end of the elevator shaft, a switch for operating a governor, a relay contact for detecting a power supply failure or a defect in the power supply, and signals processed by the CPU 22 in the control board 1, such as an abnormal low speed signal, a reverse running signal, and a CPU malfunction signal. These signals *2a* through *2p* have a logic level "L" under normal conditions and a logic level "H" upon a start failure, and are issued from the control board 1 through the input unit 26 or the output unit 27. A signal *2q* is generated by a switch ganged with a door of the elevator cage, and has a logic level "H", when the door is open and a logic level "L" when the door is closed. When the input signal $2_q$ changes from the logic level "L" to the logic level "H", a delay circuit 31 produces an output of a logic level "H" a predetermined time $T_1$ after such level change in the input signal. When the input signal *2q* goes low, the output from the delay circuit 31 immediately goes low. The delay circuit 31 serves to detect a start failure of the elevator when the elevator cage door fails to close. An OR gate 32 produces a record stopping signal 10 when any one of the signals *2a* through *2q* is representative of a start failure condition.

The output of the OR gate 32 is connected to a delay circuit 33 which serves to generate a start failure signal 4 a predetermined time $T_2$ after the record stopping signal 10 has been produced from the OR gate 32. The start failure detecting circuit 3 thus monitors the conditions of the signals 2 and issues the record stopping signal 10 to the signal recording device 8 immediately when the circuit 3 detects a start failure. The start failure detecting circuit 3 then issues the start failure signal 4 to the signal transmitting and receiving device 12 with a time delay $T_2$.

Figure 5:
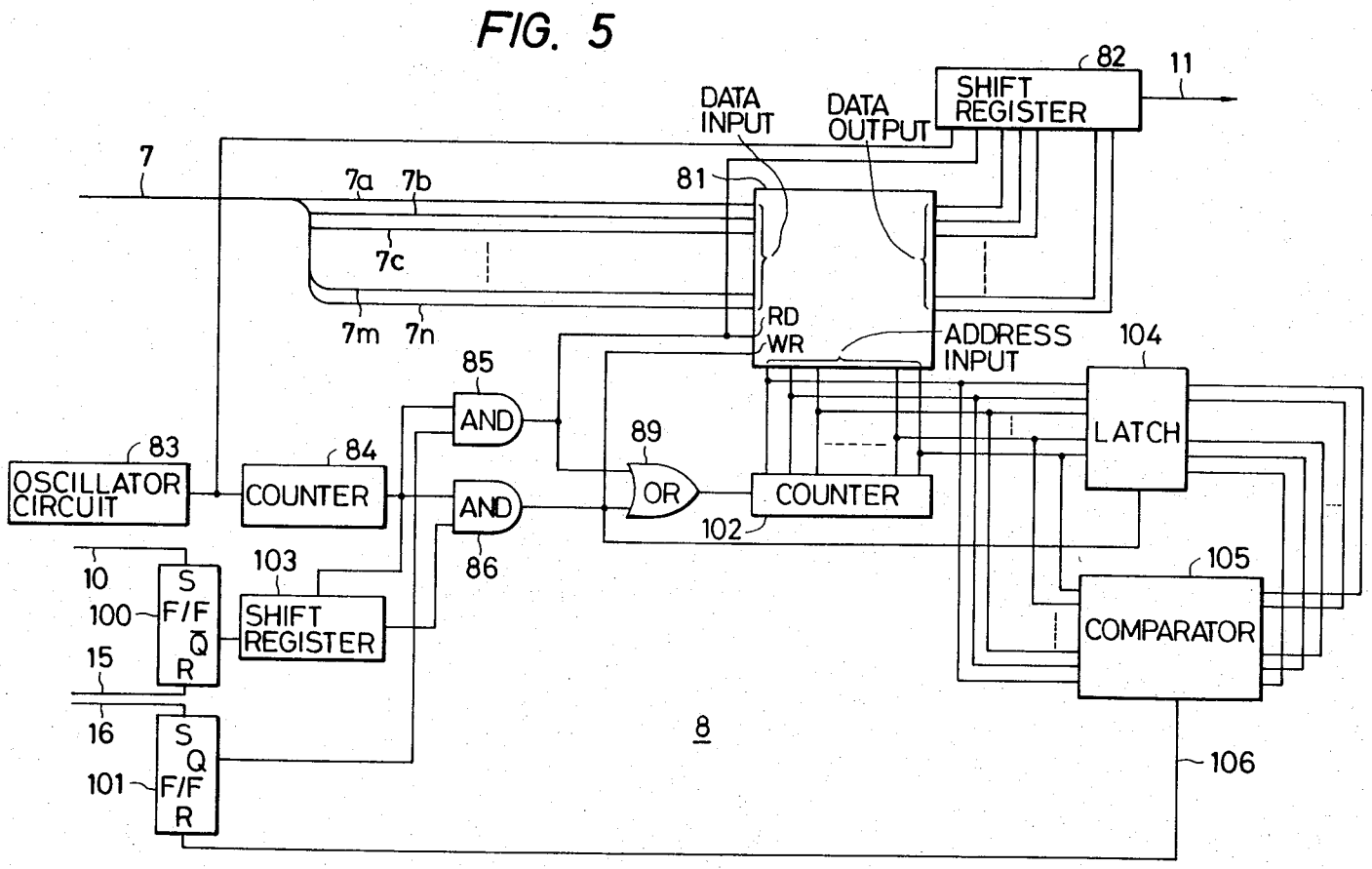
FIG. 5 is a block diagram of a signal recording device of the apparatus of FIG. 2.

FIG. 5 illustrates the signal recording device 8 in detail. The elevator operation signal 7 is necessary for monitoring the movements of the elevator and is composed of signals *7a* through *7n*. The signal recording device 8 comprises a memory 81 of n bits x m words having input terminals supplied with the signals *7a* through *7n*, a shift register 82 having parallel input terminals connected respectively to output terminals of the memory 81, an oscillator circuit 83, and a counter 84 for frequency-dividing a train of pulses from the oscillator circuit 83 with a predetermined value N1. The value N1 is selected to be greater than the number n of the signals *7a* through *7n*, or $n<N1$. The signal recording device 8 also includes AND gates 85, 86, an OR gate 89, RS flip-flops (hereinafter referred to as F/F) 100, 101, and a counter 102 for frequency-dividing a train of pulses from the OR gate 89 with a predetermined value N2. The value N2 serves to determine the number of words with which the signals 7 are recorded, and is selected to be equal to or greater than the number m of the words storable in the memory 81, or $m \geqq N2$.

The signal recording device 8 further comprises a shift registor 103, a latch circuit 104, and a comparator 105. The bit outputs from the counter 102 are applied to address terminals of the memory 81, the latch circuit 104, and the comparator 105. The comparator 105 produces an output signal 106 as a data transmission stop signal when the outputs from the counter 102 equal the outputs from the latch circuit 104. The signal transmitting and receiving device 12 applies a data read-out start signal 6 to F/F 101.

The operation of the signal recording device 8 will now be described. The shift register 103 is clocked by the output from the counter 84 and receives an output $\overline{Q}$ of the F/F 100 as a serial input to provide a time delay corresponding to the number N3 of predetermined bits of the shift register 103. The shift register 103 thus serves to establish an interval of time in which to monitor the movements of the elevator after the record stop signal 10 has been produced. The time interval is dependent on the interval between the output pulses from the counter 84 and the number of bits of the shift register 103. It is assumed that the F/F 100 is reset in advance, and the output Q thereof is at a logic level "H". When output pulses from the counter 84 reach the prescribed number N3, the output from the shift register 103 goes high, and the output pulses from the counter 84 are allowed to pass through the AND gate 86 and the OR gate 89 to the counter 102. The bit outputs from the counter 102 change each time an input pulse is applied thereto to give an address signal to the memory 81. The output from the AND gate 86 is also applied to a write terminal WR of the memory 81. Therefore, the condition of the operation signal 7 is written into the memory 81 each time an output pulse is generated from the counter 84. Likewise, the latch circuit 104 latches the output from the counter 102 or the address signal for the memory 81 each time an output pulse is produced from the counter 84. As the output from the counter 102 is incremented each time an output pulse is applied from the counter 84 and reaches the prescribed value N2, the output from the counter 102 falls to zero and the counter 102 starts counting again to write the operation signal 7 into the memory 81 endlessly.

When a record stopping signal 10 is produced from the start failure detecting circuit 3 at this time, the F/F 100 is set to thereby cause the output $\overline{Q}$ thereof to go low. When the number of output pulses from the counter 84 reaches N3, no output from the counter 84 appears at the output of the AND gate 86, rendering the counter 102 inoperative. The latch circuit 104 now latches the address that has been finally written in the memory 81.

When the data read-out signal 16 is produced from the signal transmitting and receiving device 12, the output Q from the F/F 101 goes high allowing the output pulses from the counter 84 to pass through the AND gate 85 to thereby actuate the counter 102. At the same time, parallel data are read out of the memory 81 and transferred to the shift register 82. The shift register 82 is clocked by the pulses from the oscillator circuit 83 to convert the parallel data transferred from the memory 81 into a serial signal which is then issued as a recorded signal 11. The contents of the memory 81 are successively read out by the output pulses from the counter 84 until the final storage address latched in the latch circuit 104 is reached, whereupon the F/F 101 is reset by the output from the comparator 105. The output Q of the F/F 101 goes low, preventing the AND gate 85 from delivering the pulses from the counter 84. The read-out operation of the memory 81 is thus completed.

Figure 6:
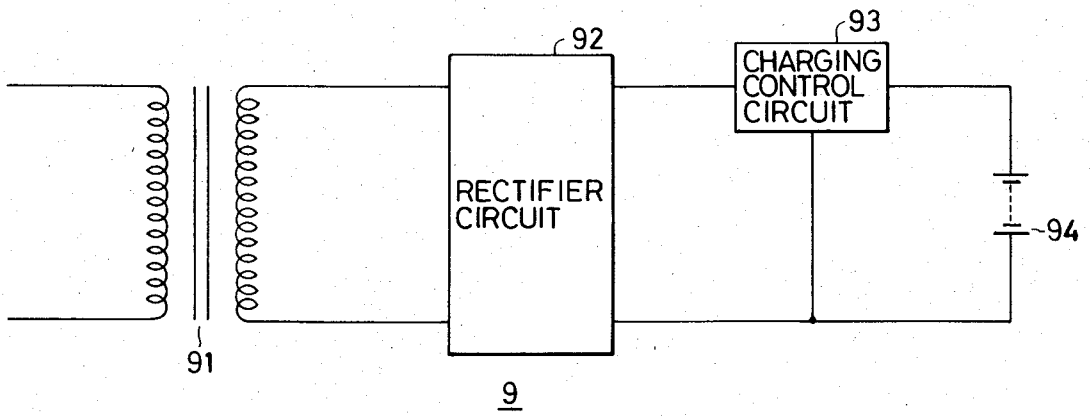
FIG. 6 is a block diagram of a no-break power unit of the apparatus of FIG. 2.

The no-break power unit 9 is shown in greater detail in FIG. 6. The no-break power unit 9 has a primary side connected to an AC power supply and includes a rectifier circuit 92 for converting AC to DC current. The no-break power unit 9 also has a charging control circuit 93 for monitoring the voltage across the storage batteries 94 to control a current for charging these storage batteries. The storage batteries 94 supply current to the start failure detecting circuit 3, the signal recording device 8, and the signal transmitting and receiving device 12 so that these devices will be able to operate at the time of a power supply failure.

Figure 7:
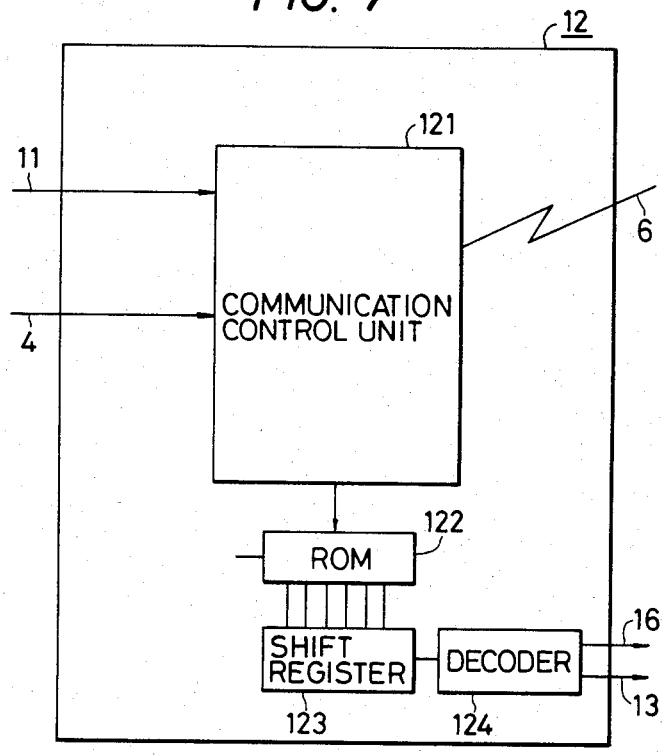
FIG. 7 is a block diagram of a signal transmitting and receiving device of the apparatus of FIG. 2.

FIG. 7 shows the signal transmitting and receiving device in detail. The signal transmitting and receiving device includes a communication control unit 121, a read-only memory (hereinafter referred to as a "ROM") 122 for storing the telephone number of the maintenance and service company, the maintenance number of the elevator, and other data, a shift register 123 for converting a received signal into parallel signals, and a decoder circuit 124 for dividing received signals. The decoder circuit 124 produces the data read-out signal 16 for reading recorded data out of the signal recording device 8 and the restoration command 13 for bringing the elevator back to its initialized condition.

The operation of the signal transmitting and receiving device 12 will now be described in detail. In response to the start failure signal 4 from the start failure detecting circuit 3, the communication control unit 121 reads the telephone number of the maintenance and service company stored in the ROM 122 and dials that telephone number. When the telephone line becomes available for communication, the communication control unit 121 delivers out the maintenance number of the elevator and other necessary data. Thereafter, the communication control unit 121 receives a signal delivered from the maintenance and service company. The serial signal is converted by the shift register 123 into parallel signals, which are then decoded by the decoder 124. If the decoded signal is a data read-out command, then the decoder 124 produces a data read-out signal for reading out the recorded data indicative of the operating conditions of the elevator. If the decoded signal is an elevator restoration command, then the decoder 124 produces a restoration command.

Figure 8:
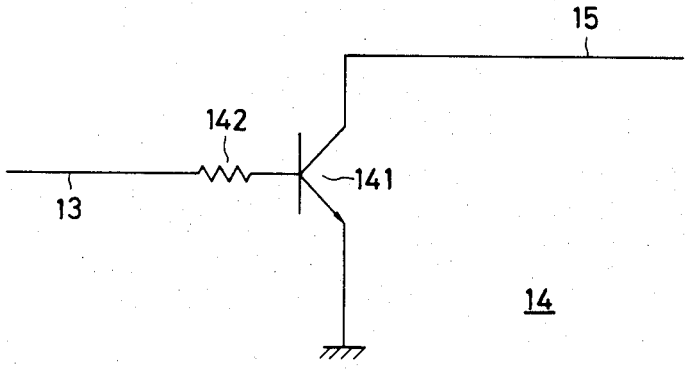
FIG. 8 is a circuit diagram of a reset circuit of the apparatus illustrated in FIG. 2.

The reset circuit 14 is illustrated in detail in FIG. 8. The reset circuit 14 is composed of a transistor 141 having a base connected to a resistor 142 and receptive of the restoration command from the signal transmitting and receiving device 12. The transistor 141 has a grounded emitter and a collector for issuing the reset signal 15. When the restoration command 13 is applied from the signal transmitting and receiving device 12, the transistor 141 is turned on to cause the reset signal 15 to go low to thereby initialize the CPU 23 in the control board 1. At the same time, the F/F 100 in the signal recording device 8 is reset to allow the signal recording device 8 to effect its signal recording operation.

Although a certain preferred embodiment has been shown and described, it should be understood that many changes and modifications may be made therein without departing from the scope of the appended claims.

What is claimed is:

1. An apparatus for signaling elevator malfunctions, comprising:

(a) a control board for controlling the elevator;

(b) a start failure detecting circuit for detecting an elevator start failure based on a control signal from said control board;

(c) a signal recording device for recording an elevator operation signal from said control board and for holding recorded conditions prior and subsequent to said elevator start failure based on an output from said start failure detecting circuit;

(d) a signal transmitting and receiving device responsive to an output from said start failure detecting circuit to automatically dial a telephone number of a maintenance and service center to transmit data recorded by said signal recording device to said maintenance and service center and for receiving a restoration command from said maintenance and service center; and (e) a reset circuit responsive to the restoration signal received by said signal transmitting and receiving device for restoring said control board to the same condition as when a power supply therefor is first switched on.

2. An apparatus as claimed in claim 1, wherein said signal recording device includes a storage medium for repeatedly storing elevator operation signals from said control board, and for erasing older information when full to store new information.

3. An apparatus as claimed in claim 1, said start failure detecting circuit issuing a signal for stopping the recording operation of said signal recording device upon detection of an elevator start failure.

4. An apparatus as claimed in claim 1, and further including a no-break power unit for ensuring operation of said signal recording device at the time of a power supply failure by supplying electric power to said signal recording device to thereby prevent recorded information from being erased.

5. An apparatus as claimed in claim 4, wherein said no-break power unit is enabled to power said start failure detecting circuit and said signal transmitting and receiving device.

6. An apparatus as claimed in claim 1, wherein said signal recording device issues recorded information in response to a data read-out signal from said signal transmitting and receiving device.

7. An apparatus as claimed in claim 3, wherein said reset circuit applies a reset signal to said signal recording device to resume a signal recording operation thereof.

8. An apparatus as claimed in claim 1, said start failure detecting circuit issuing said output to said signal transmitting and receiving device with a predetermined delay time.

9. An apparatus as claimed in claim 1, wherein said control board includes a microcomputer, input and output units and RAM and ROM memories, a reset terminal of said microcomputer receiving a reset signal generated by said reset circuit to initialize said microcomputer, selected signals from said input unit and said output unit being combined to form said control signal and said elevator operation signal.

10. An apparatus as claimed in claim 3, said signal recording device including erasable memory means for recording said elevator operation signal, flip-flop means for receiving said recording stop signal from said start failure detection circuit, and shift register means for establishing a time interval in which said elevator operation signal is recorded after said recording stop signal.

11. An apparatus as claimed in claim 10, including flip-flop means for receiving said data read-out signal for enabling transmitting of said recorded conditions to said signal transmitting and receiving device.

* * * * *